United States Patent [19]

Baldridge et al.

[11] 4,320,992

[45] Mar. 23, 1982

[54] GROUT DISTRIBUTION SYSTEM

[75] Inventors: Morris G. Baldridge; Lloyd C. Knox; Bob L. Sullaway, all of Duncan, Okla.

[73] Assignee: Halliburton Company, Duncan, Okla.

[21] Appl. No.: 144,712

[22] Filed: Apr. 28, 1980

[51] Int. Cl.[3] ..... E02B 17/00; E02D 5/34

[52] U.S. Cl. ..... 405/223; 405/225; 405/240

[58] Field of Search ..... 405/222, 223, 224, 225, 405/226, 227, 240, 269, 248; 222/478, 565

[56] References Cited

U.S. PATENT DOCUMENTS

| | | | |
|---|---|---|---|
| 1,065,229 | 6/1913 | Estes | 405/248 X |
| 3,518,835 | 7/1970 | Perry | 405/225 X |
| 3,564,856 | 2/1971 | Blount et al. | 405/225 |
| 3,824,794 | 7/1974 | Hubby | 405/225 |

FOREIGN PATENT DOCUMENTS

| | | | |
|---|---|---|---|
| 1429312 | 3/1976 | United Kingdom | 405/248 |

*Primary Examiner*—David H. Corbin

*Attorney, Agent, or Firm*—John H. Tregoning; James R. Duzan

[57] ABSTRACT

A grout distribution system for grouting the interior of a piling driven through a jacket leg of a marine platform or grouting the interior of a similar cylindrical structure.

2 Claims, 2 Drawing Figures

GROUT DISTRIBUTION SYSTEM

This invention relates to a grout distribution system for large cylindrical members. More specifically, this invention relates to a grout distribution system for the legs of a marine platform.

In geographic areas where marine platforms are subject to underwater avalanches, the deposition of large quantities of silt about the base of the platform after it has been installed, or the installation of the platform in areas having a soft and muddy bottom such that the platform sinks deeply therein, it is sometimes desirable to install the conductor pipes through which the oil or gas wells are drilled from the platform in the platform legs to prevent damage thereto. After the conductor pipes are installed in the platform legs, to help stabilize the platform it is desirable to fill the interior of the platform leg having a piling driven therethrough and conductor pipes installed therein with grouting material, thereby securing the conductor pipes in position.

Typically, to grout the interior of the platform legs a line is merely inserted into the leg to the desired level at which grout is to be placed and grout pumped therefrom until the leg is locally or completely filled with grout. If it has been only locally filled, when the grout has hardened the line is then raised and the next section of the leg grouted. While this method and apparatus is simple to use, it is time consuming and it is difficult to obtain a uniform grout distribution throughout the interior of the leg from a single grout line.

In contrast to this prior art method and apparatus, the present invention comprises a grouting system which may be installed in the platform leg after the piling has been driven therethrough which allows the interior of the piling having conductor pipes installed therein of the platform leg to be grouted in a series of stages, each stage having a uniform distribution of grouting material throughout.

The foregoing invention will be more fully understood from the following specification taken in conjunction with the drawings wherein.

Figure 1:
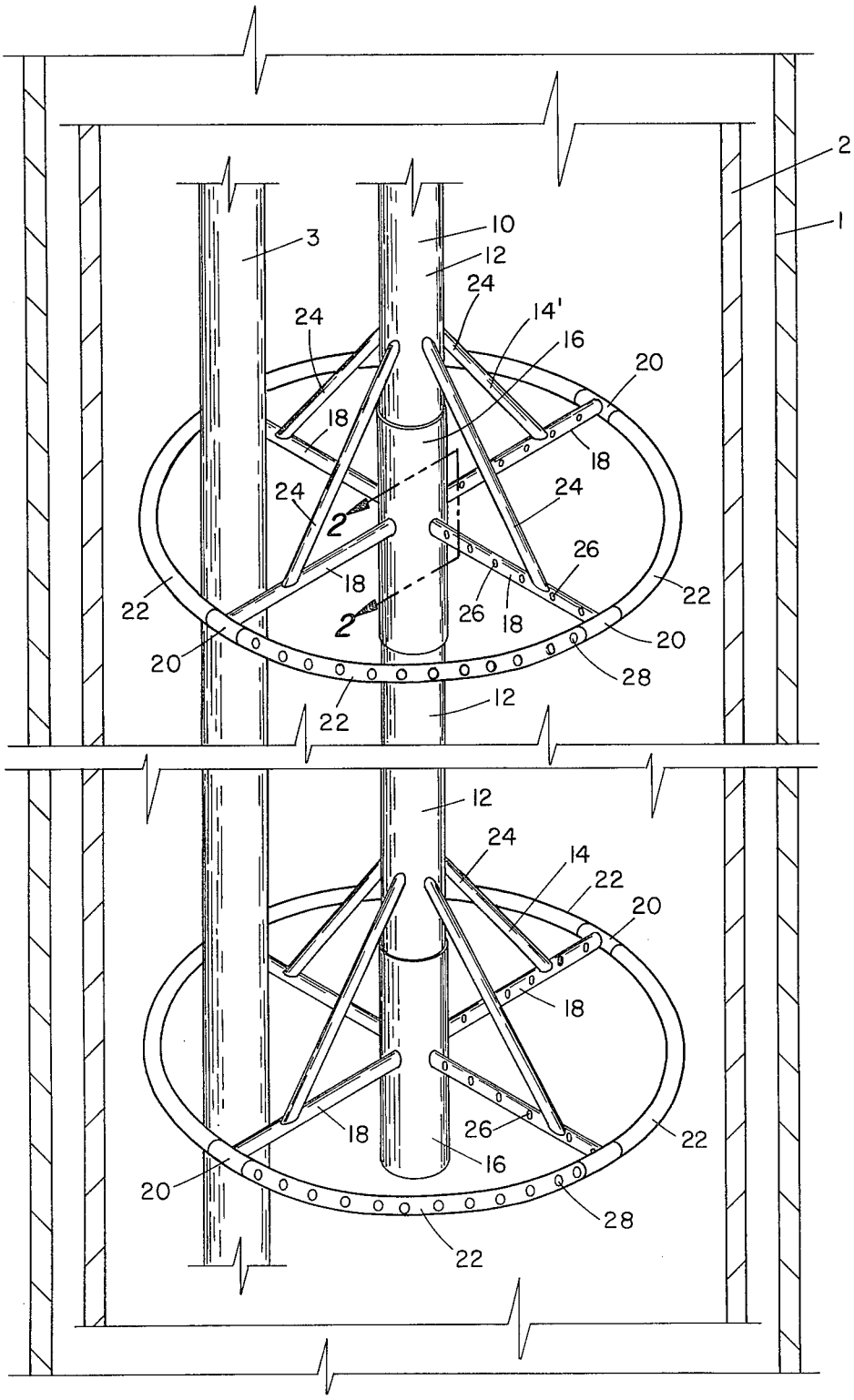
FIG. 1 is a perspective view of the present invention installed in the interior of a platform jacket leg having a piling driven therethrough.

Referring to FIG. 1, a preferred embodiment of the present invention is shown.

The jacket leg 1 of a marine platform is shown having a piling 2 driven therethrough. A conductor pipe 3 is shown extending through the grout distribution system 10 installed within the interior of the piling 2.

The grout distribution system 10 comprises a plurality of pipes or conduits 12 interconnecting a plurality of grout distribution rings 14.

The pipes or conduits 12 may be of any readily available type.

Each grout distribution ring 14 comprises a central sleeve member 16 having a plurality of radially extending conduits 18 extending outwardly therefrom and communicating therewith which, in turn, have a pipe tee means 20 on one end thereof, each radially extending conduit means 18 having the end thereof having a pipe tee thereon interconnected with an adjacent radially extending conduit means 18 by means of an arcuate shaped conduit means 22. For structural stability, a plurality of reinforcing means 24 extend from each radially extending conduit means 18 to the pipe or conduit 12 secured to the central sleeve member 16. The reinforcing means 24 may be secured in position by any convenient means, such as welding.

Each radially extending conduit means 18 contains a plurality of apertures 26 therein to allow the grout to flow therefrom. Also, each arcuate shaped conduit means 22 contains a plurality of apertures 28 therein to allow the grout to flow therefrom.

The reinforcing means 24 may be secured either to the central sleeve member 16 or pipe or conduit 12 and may extend and be secured on either side, either upwardly or downwardly, of the radially extending conduit means 18.

The radially extending conduit means 18 may be of any desired length but it is preferred that they terminate adjacent the interior wall of the piling 3 such that when the arcuate shaped conduit means 22 are interconnected with the pipe tees 20 on the ends of conduit means 18, a circular conduit means is formed adjacent the interior wall of the piling 3 for the grout to flow uniformly therefrom.

It should be understood that the plurality of apertures 26 in the radially extending conduit means 18 and the plurality of apertures 28 in the arcuate shaped conduit means 22 are sized such that grout will flow uniformly therefrom.

The central sleeve means 16 comprises a tubular member. A sliding sleeve valve means 30 may be contained within the central sleeve means 16, if desired.

Figure 2:
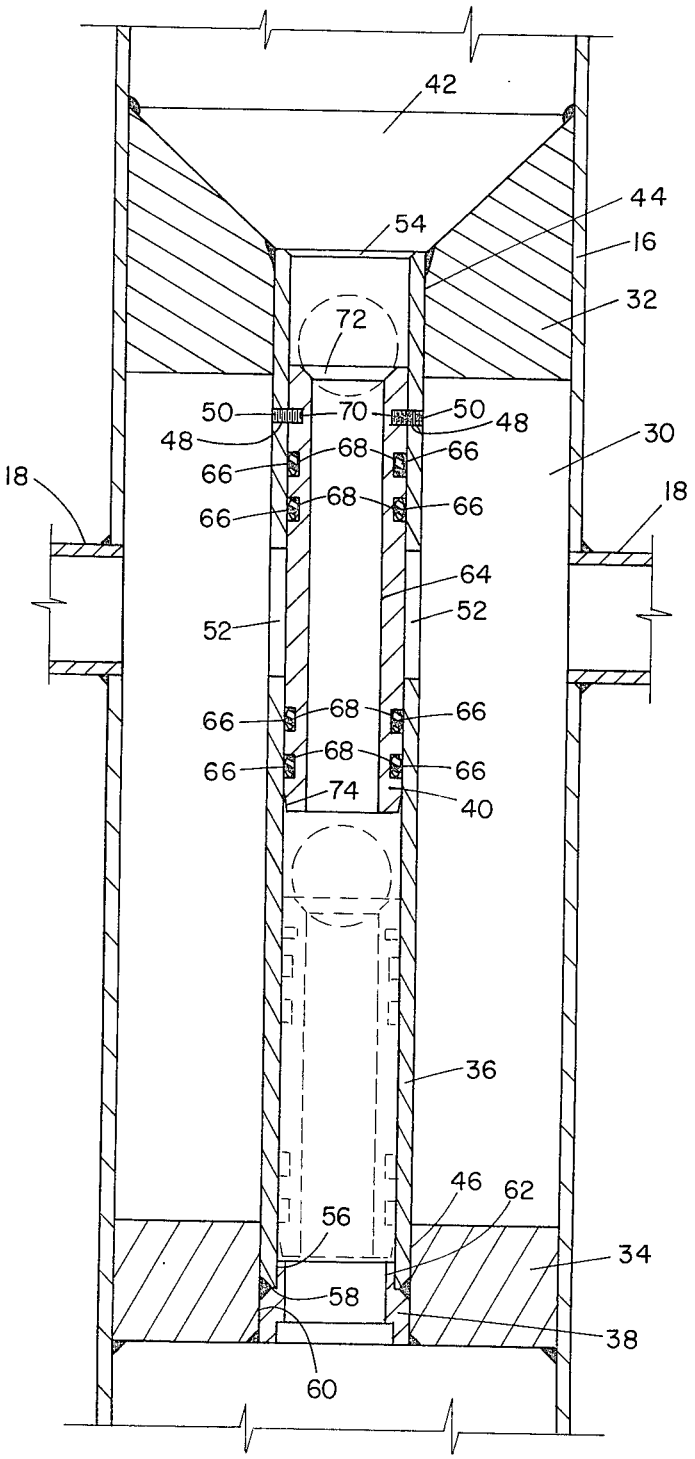
FIG. 2 is a cross-sectional view of a valved utilized in the invention of FIG. 1 taken along lines 2—2 of FIG. 1.

Referring to FIG. 2, the sliding sleeve valve means 30, which may be installed within central sleeve means 16, is shown in cross-section. The sliding sleeve valve means 30 comprises upper member 32, lower member 34, cylindrical member 36, end member 38 and sleeve means 40.

The upper member 32 comprises a cylindrical member having an outer diameter substantially the same as the internal diameter of the central sleeve means 16, having a conical bore 42 and having a cylindrical bore 44. The upper member 32 may be secured to the central sleeve means 16 by any suitable means, such as welding.

The lower member 34 comprises a cylindrical member having an outer diameter substantially the same as the internal diameter of the central sleeve means 16 and having a cylindrical bore 46 therethrough. The lower member 34 may be secured to the central sleeve means 16 by any suitable means, such as welding.

The cylindrical member 36 comprises an elongated cylindrical member having a plurality of threaded apertures 48 receiving a plurality of threaded shear pin means 50 therein and having a plurality of apertures 52 therein. If desired, the upper end of the cylindrical member 36 may have annular chamfered surface 54 in the bore therethrough. The cylindrical member 36 may be secured to the upper member 32 at the intersection of the conical bore 42 and cylindrical bore 44 therein by any suitable means, such as welding.

The end member 38 comprises a cylindrical member having a first cylindrical portion 56 having substantially the same diameter as the bore through cylindrical member 36, having annular shoulder 58 thereon, having second cylindrical portion 60 having substantially the same diameter as the cylindrical bore 46 through lower member 34, and having bore 62 therethrough. The end member 38 may be secured to the lower end of cylindrical member 36 and to lower member 34 by any suitable means, such as welding.

The sleeve means 40 comprises an elongated cylindrical member having an outer diameter substantially the same as the bore through cylindrical member 36 and a bore 64 therethrough. Installed in the outer surface of the sleeve means 40 are a plurality of seal means 66 received within annular seal cavity means 68. Also contained in the outer surface of the sleeve means 40 are a plurality of blind apertures or annular groove 70 which receive a portion of threaded shear pin means 50 therein. As shown, when the sleeve means 40 is installed in the cylindrical member 36 in a first position having the threaded shear pin means 50 engaging blind apertures or annular groove 70, the seal means 66 are positioned such that the seal means 66 sealingly engage the bore of cylindrical member 36 to isolate apertures 52 from any fluid flow therethrough.

The seal means 66 may be any suitable type of seal means, such as an elastomeric O-ring type seal means.

As shown, the inlet of bore 64 of the sleeve means 40 contains an annular chamfered surface 72 and the exterior surface contains an annular chamfered surface 74 on one end thereof.

Referring again to FIG. 1, to utilize the grout distribution system 10, as the conductor pipes 3 are assembled and inserted into the piling 2 of the jacket leg 1 of a marine platform, the grout distribution rings 14 having conduits 12 connected thereto are assembled therewith and simultaneously inserted with the conductor pipes 3. It will be understood that the grout distribution ring 14, which is initially inserted into the piling 2 and jacket leg 1 along with conductor pipes 3, will have the lower end of central sleeve means 16 sealed to prevent any fluid flow therefrom as it is not connected to a conduit 12. It will also be understood that the initial grout distribution ring 14 does not usually contain any sliding sleeve valve means 30 therein so that any fluid flow into central sleeve means 16 will flow directly from the central sleeve means 16 into the conduit means 18.

At any desired location above the installation of the initial grout distribution ring 14, another grout distribution ring 14' having a sliding sleeve valve means 30 therein may be installed along with the conductor pipes 3 in the interior of the piling 2 of a jacket leg 1.

Still referring to FIG. 1, the procedure utilized to grout the interior of a piling 2 having a plurality of conductor pipes 3 and a grout distribution system 10 having two grout distribution rings 14 and 14' as described hereinbefore will be set forth. After the conductor pipes 3 and grout distribution system 10 have been installed in the piling 2, grout is initially pumped through conduits 12 to the initial grout distribution ring 14 and flows therefrom through apertures 26 and 28 in the radially extending conduit means 18 and arcuate shaped conduit means 22 respectively into the interior of the piling 2. When the desired amount of grout has been introduced into the interior of the piling 2, the pumping of grout is discontinued and the grout in the piling 2 is allowed to set, thereby forming a plug in the interior of the piling 2 sealing the interior of the piling 2 having the plurality of conductor pipes 3 therein.

After the initial plug of grout has set and it is desired to grout the remaining portion of the interior of the piling 2, a ball having a diameter substantially the same as the bore of cylindrical member 36 of the sliding sleeve valve means 30 installed in central sleeve 16 of grout distribution ring 14 is inserted and pumped or allowed to free fall through the conduit 12 until it sealingly engages annular chamfered surface 72 of the sleeve means 40 of the valve means 30. (Refer to FIG. 2, ball shown in broken lines.) When the ball has sealingly engaged annular chamfered surface 72, fluid pressure is increased in the conduit 12 until the increased fluid pressure causes the shear pin means 50 retaining the sleeve means 40 in a first position in cylindrical member 36 blocking fluid flow through apertures 52 therein to shear, thereby allowing sleeve means 40 to move through cylindrical member 36 to a second position therein uncovering the apertures 52 to allow fluid flow therethrough. When the shear pin means 50 are sheared and the sleeve means 40 moves to uncover the apertures 52 in cylindrical member 36, the uncovering of the apertures 52 will be indicated by a drop in fluid pressure in the conduit 12 and a rate of fluid flow therethrough.

After fluid flow has been established through the grout distribution ring 14' having sliding sleeve valve means 30 therein, grout is again pumped through the conduits 12, through grout distribution ring 14' into the interior of piling 2 until such time as the interior of the piling 2 having conductor pipes 3 therein is filled to the desired level. At this point the grout is again allowed to harden, thereby completely sealing the interior of the piling 2 and forming a unified structure of the piling 2, conductor pipes 3 and grout distribution system 10.

Alternately, if it is desired to use more than two grout distribution rings 14 in the grout distribution system 10, the bottom or initial grout distribution ring 14 having no sliding sleeve valve means 30 therein and having one end thereof blocked to fluid flow, the grout distribution rings 14' thereabove need only contain sliding sleeve valve means 30 which are actuated by balls of differing diameter, the sliding sleeve valve means 30 which is actuated by the smallest diameter ball being installed after the initial grout distribution ring 14.

It should be understood that if desired, the initial grout distribution ring 14 may be installed having a sliding sleeve valve means 30 therein. In that event, it will be necessary that the sliding sleeve valve means 30 of the initial grout distribution ring 14 be actuated with a smaller ball than that of any other grout distribution ring 14'. Also, to uniformly fill the interior of the piling 2 with grout rather than just pumping grout out one end of central sleeve 16, it will be necessary to actuate the sleeve means 40 in the sliding sleeve valve means 30 to allow grout to flow from the radially extending conduit means 18 and arcuate shaped conduit means 22.

It should also be recognized that if desired, the sliding sleeve valve means 30 may be modified to be actuated by a cementing plug or similar type means rather than a ball.

From the foregoing, it can be easily seen that the grout distribution system of the present invention offers the advantages of being simple and inexpensive to construct, simple to use, adaptable to grout any volume by proper staging and number of grout distribution rings, and adaptable to any size piling or similar type structure.

Although the present invention has been described with respect to grouting a plurality of conductor pipes installed within the piling of the jacket leg of a marine platform, the present invention may be utilized in any similar grouting environment and is not limited to use in marine structures.

Having thus described my invention, I claim:

1. A grout distribution system comprising:

first grout distribution ring means including:

central sleeve means having a plurality of apertures therein;

a plurality of radially extending conduit means, each conduit means having one end thereof secured to the central sleeve means to allow communication between the interior of the central sleeve means through an aperture of the plurality of apertures therein and the interior of each radially extending conduit means; and a plurality of arcuate shaped conduit means interconnecting the other end of each conduit means of the plurality of radially extending conduit means thereby allowing communication between the interior of each of the conduit means of the plurality of radially extending conduit means and the interior of each arcuate shaped conduit means of the plurality of arcuate shaped conduit means, each arcuate shaped conduit means having a plurality of apertures therein;

first conduit means connected to one end of the central sleeve means of said first grout distribution ring means thereby communicating with the interior of the central sleeve means;

second grout distribution ring means including:

central sleeve means having a plurality of apertures therein, having sliding sleeve valve means therein, and having one end thereof connected to said first conduit means connected to the central sleeve means of said first grout distribution ring means, the sliding sleeve valve means comprising:

upper member means secured to the central sleeve means of said second grout distribution ring means;

lower member means secured to the central sleeve means of said second grout distribution ring means;

cylindrical member means having a plurality of apertures therein and having one end thereof secured to the upper member means;

end member means secured to the other end of the cyindrical member means and the lower member means; and sleeve means slidably disposed within the cylindrical member means in sealing engagement therewith;

a plurality of radially extending conduit means, each conduit means having one end thereof secured to the central sleeve means to allow communication between the interior of the central sleeve means through an aperture of the plurality of apertures therein and the interior of each radially extending conduit means; and a plurality of arcuate shaped conduit means interconnecting the other end of each conduit means of the plurality of radially extending conduit means thereby allowing communication between the interior of each of the conduit means of the plurality of radially extending conduit means and the interior of each arcuate shaped conduit means of the plurality of arcuate shaped conduit means, each arcuate shaped conduit means having a plurality of apertures therein; and second conduit means connected to one end of the central sleeve means of said second grout distribution ring means thereby communicating with the interior of the central sleeve means.

2. The grout distribution system of claim 1 wherein said first grout distribution ring means further includes:

reinforcing means connected to the plurality of radially extending conduit means and said first conduit means connected to the central sleeve means; and said second grout distribution ring means further includes:

reinforcing means connected to the plurality of radially extending conduit means and said second conduit means connected to the central sleeve means.

* * * * *